US009228373B2

(12) United States Patent
Huang

(10) Patent No.: US 9,228,373 B2
(45) Date of Patent: Jan. 5, 2016

(54) COMBINATION-IDENTIFIABLE PADLOCK

(71) Applicant: Chien-Yung Huang, New Taipei (TW)

(72) Inventor: Chien-Yung Huang, New Taipei (TW)

( * ) Notice: Subject to any disclaimer, the term of this patent is extended or adjusted under 35 U.S.C. 154(b) by 0 days.

(21) Appl. No.: 14/287,397

(22) Filed: May 27, 2014

(65) Prior Publication Data

US 2014/0352370 A1 Dec. 4, 2014

(30) Foreign Application Priority Data

Jun. 3, 2013 (TW) ..... 102210381 U

(51) Int. Cl.
*E05B 37/00* (2006.01)
*E05B 37/02* (2006.01)

(52) U.S. Cl.
CPC ..... *E05B 37/0034* (2013.01); *E05B 37/0041* (2013.01); *E05B 37/025* (2013.01); *Y10T 70/415* (2015.04)

(58) Field of Classification Search
CPC . E05B 37/0034; E05B 37/0041; E05B 37/02; E05B 37/0025; E05B 37/0037; E05B 37/025; Y10T 70/415
USPC .... 70/20, 21, 24–26, 38 R, 38 A, 38 B, 38 C, 70/284, 285, DIG. 63, DIG. 71
See application file for complete search history.

(56) References Cited

U.S. PATENT DOCUMENTS

| | | | | |
|---|---|---|---|---|
| 3,172,279 | A * | 3/1965 | Patriquin | 70/38 A |
| 7,677,065 | B1 * | 3/2010 | Miao | 70/57 |
| 2004/0194516 | A1 * | 10/2004 | Chen | 70/54 |
| 2008/0120999 | A1 * | 5/2008 | Lee | 70/21 |
| 2013/0055774 | A1 * | 3/2013 | Yang | 70/307 |

FOREIGN PATENT DOCUMENTS

| | | | |
|---|---|---|---|
| EP | 2738326 | A1 * | 6/2014 |
| WO | WO 2010118805 | A1 * | 10/2010 |

OTHER PUBLICATIONS

Bonenberger, Paul R.. (2000). First Snap-Fit Handbook—Creating Attachments for Plastic Parts—3.2.2.2 Locator Pairs, Constraint and Strength. Hanser Publishers. Online version available at:http://app.knovel.com/hotlink/pdf/id:kt003KA3Q1/first-snap-fit-handbook-2/locator-pairs-constraint.*

* cited by examiner

*Primary Examiner* — Lloyd Gall
*Assistant Examiner* — Amanda L Miller
(74) *Attorney, Agent, or Firm* — patenttm.us

(57) ABSTRACT

A combination-identifiable padlock has a shell, a combination lock cylinder, a key lock cylinder and an identification assembly. The combination lock cylinder, the key lock cylinder and the identification assembly are mounted in the shell. When the correct key is inserted, the key lock cylinder is rotatable to actuate the identification assembly and combination lock cylinder is actuated to identify the combination. Therefore, the combination is retrievable to avoid the combination lock cylinder to become unusable when the combination is forgotten.

8 Claims, 12 Drawing Sheets

COMBINATION-IDENTIFIABLE PADLOCK

CROSS-REFERENCE TO RELATED APPLICATIONS

This application is based upon and claims priority under 35 U.S.C. 119 from Taiwan Patent Application No. 102210381 filed on Jun. 3, 2013, which is hereby specifically incorporated herein by this reference thereto.

BACKGROUND OF THE INVENTION

1. Field of the Invention

The present invention relates to a combination-identifiable padlock, especially to a padlock with combination lock cylinder and a key lock cylinder.

2. Description of the Prior Arts

Padlocks are common used small locks to easily lock objects such as bicycles, cabinets, suitcases and so on. Combination lock cylinders are usually used in the padlocks to perform locking and unlocking. If the user forgets the combination, the conventional padlock can only be broken to be unlocked and the broken conventional padlock cannot be reused. Therefore, some of the conventional padlocks have both a combination lock cylinder and a key lock cylinder. When the user forgets the combination, the user can still use a key to unlock the conventional padlock.

However, even the user can unlock the conventional padlock by the key when the combination is forgotten, the forgotten combination is still unknown. Then the conventional padlock is only able to be unlocked by the key while the combination lock cylinder is no longer operable since the combination is unidentified. Therefore, even the conventional padlock can be unlocked by the key, the conventional padlock still lose partial function after the combination is forgotten.

To overcome the shortcomings, the present invention provides a combination-identifiable padlock to mitigate or obviate the aforementioned problems.

SUMMARY OF THE INVENTION

The main objective of the present invention is to provide a combination-identifiable padlock. The combination-identifiable padlock has a shell, a combination lock cylinder, a key lock cylinder and an identification assembly. The combination lock cylinder, the key lock cylinder and the identification assembly are mounted in the shell. When the correct key is inserted, the key lock cylinder is rotatable to actuate the identification assembly and combination lock cylinder is actuated to identify the combination. Therefore, the combination is retrievable to avoid the combination lock cylinder to become unusable when the combination is forgotten.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
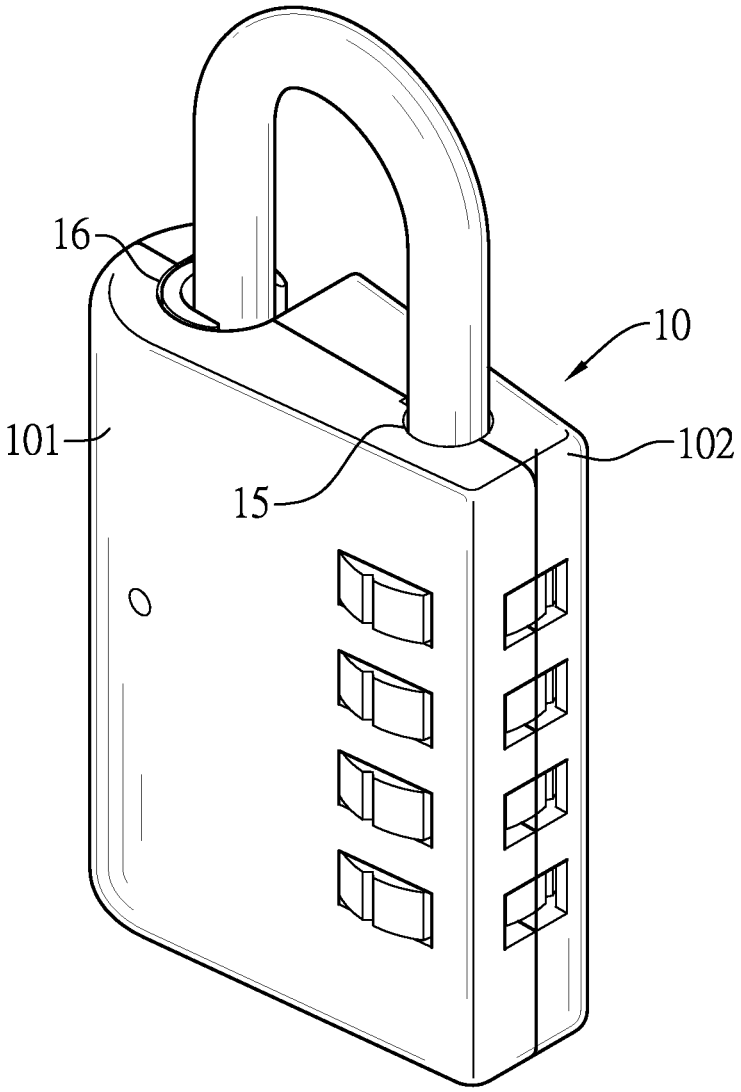
FIG. 1 is a perspective view of a combination-identifiable padlock in accordance with the present invention.
Figure 2:
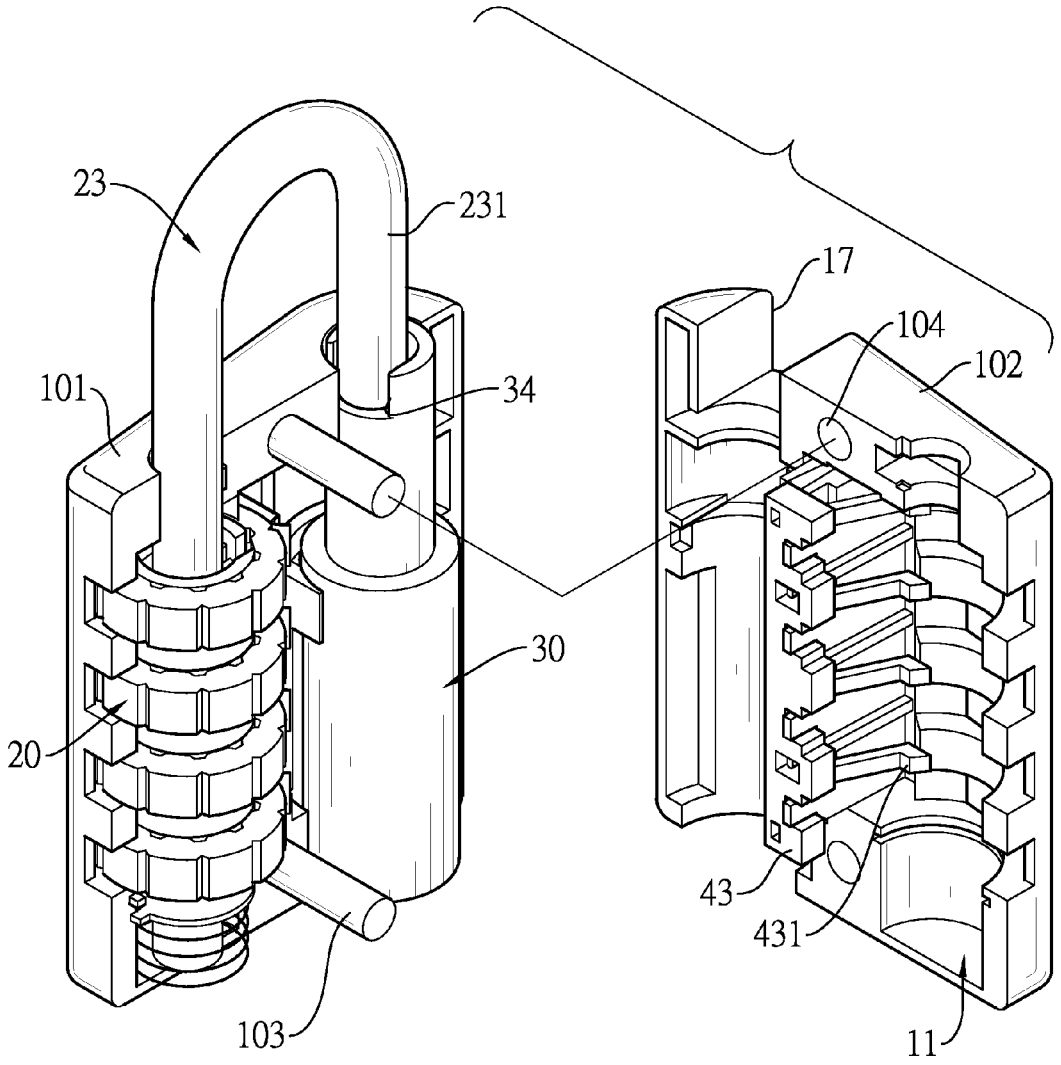
FIG. 2 is a partially exploded perspective view of the combination-identifiable padlock in FIG. 1.

With reference to FIGS. 1 and 2, a combination-identifiable padlock in accordance with the present invention comprises a shell 10, a combination lock cylinder 20, a key lock cylinder 30 and an identification assembly 40.

Figure 3:
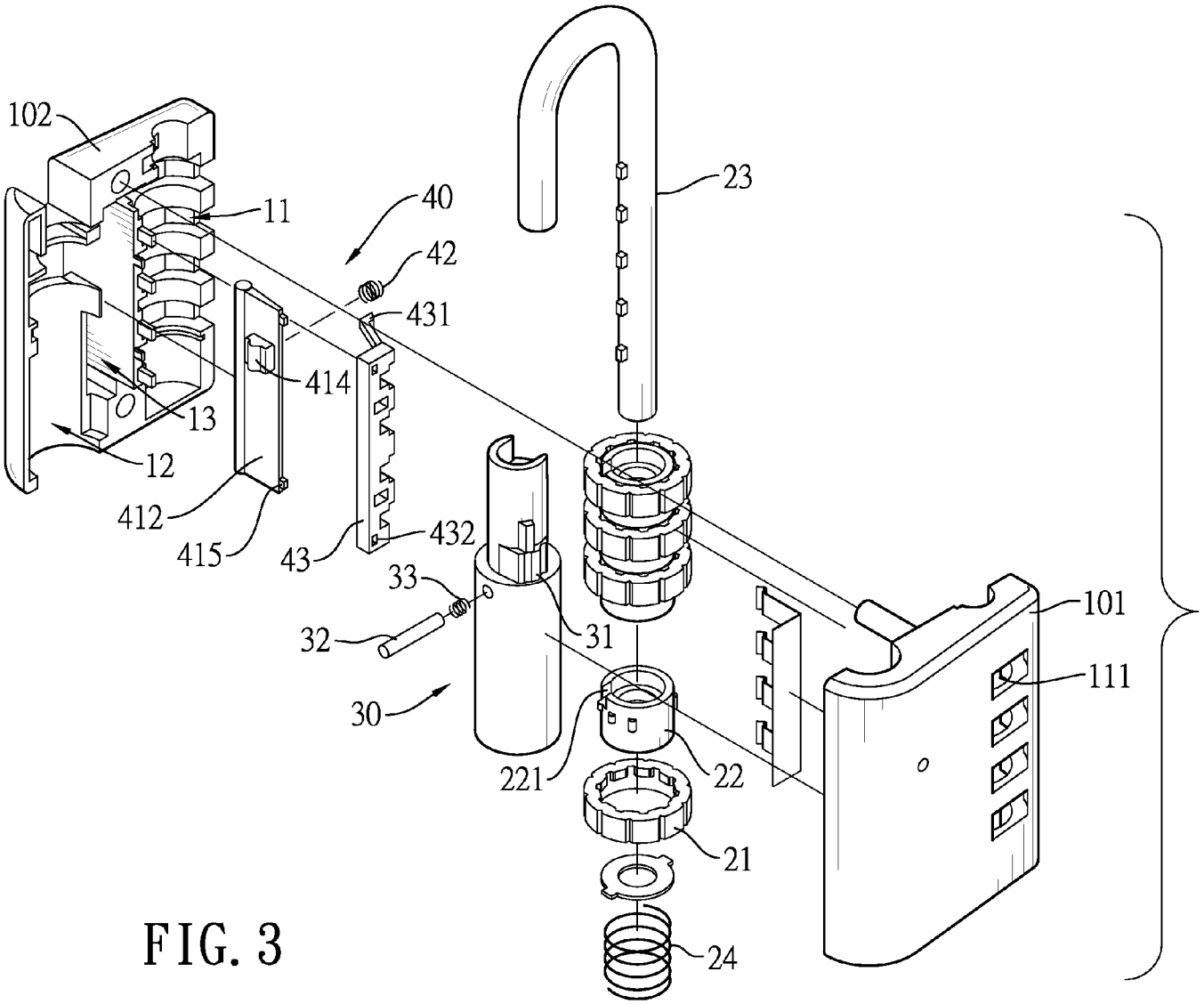
FIG. 3 is an exploded perspective view of the combination-identifiable padlock in FIG. 1.
Figure 4:
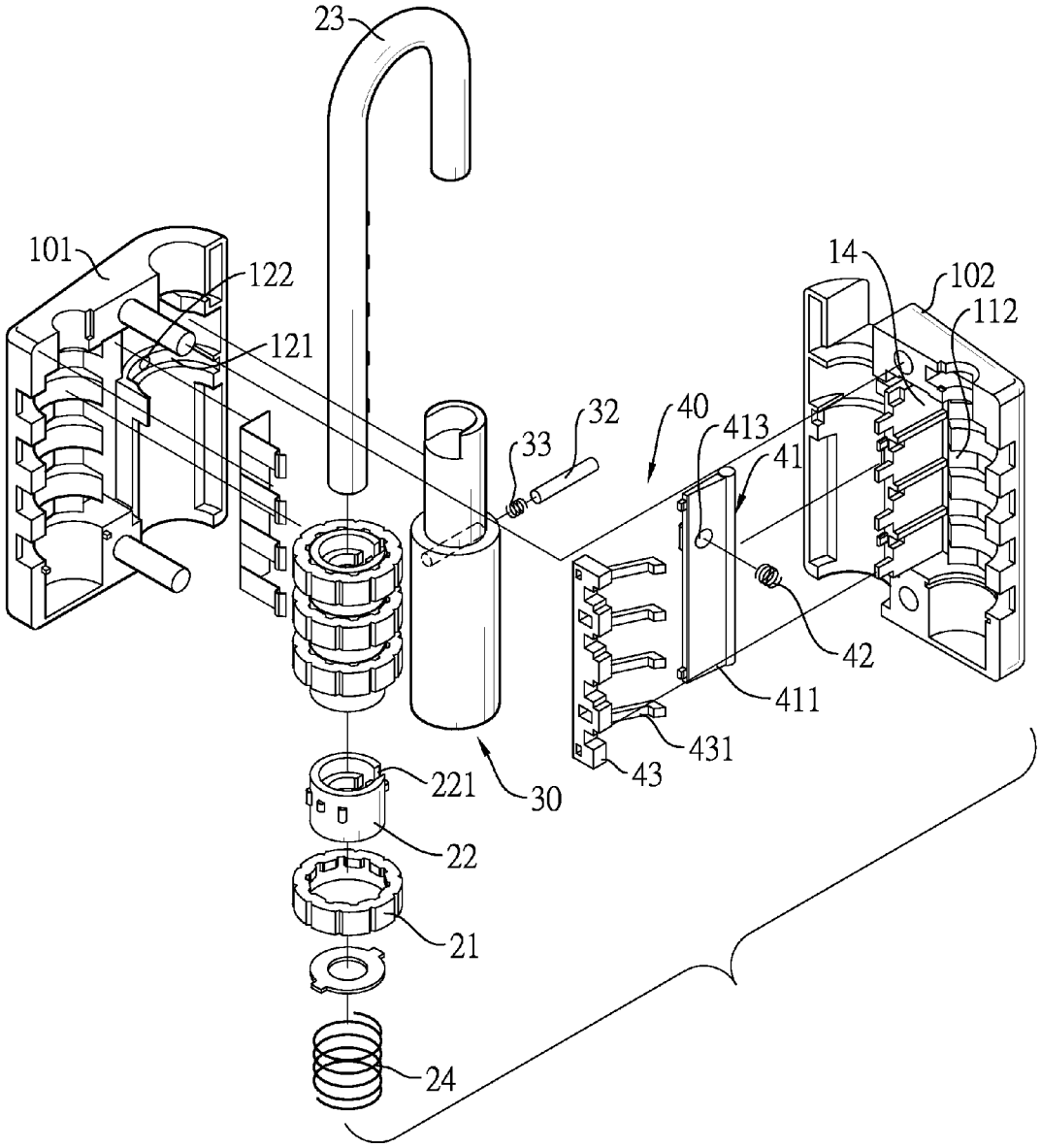
FIG. 4 is another exploded perspective view of the combination-identifiable padlock in FIG. 1.

With reference to FIGS. 2 to 4, the shell 10 has a front shell 101 and a rear shell 102 connected to each other by multiple pins 103 and multiple mounting holes 104. The pins 103 may be riveted to fasten the front and rear shells 101, 102. The shell 10 has a first room 11, a second room 12 and a third room 13. The third room 13 is defined between the first and second rooms 11, 12. A partition 14 is formed between the second and third rooms 12, 13. The front shell 101 has multiple through holes 111 formed therethrough and communicating with the first room 11. The rear shell 102 has multiple receiving recesses 112 formed therein and communicating with the third room 13. Each receiving recess 112 corresponds to one of the through holes 111 on the front shell 101. The front shell 101 has a sliding slot 121 formed therein and communicating with the second room 12. The front shell 101 has a positioning hole 122 formed therethrough and located in the sliding slot 121. A rod hole 15 is formed through a top of the shell 10 and communicates with the first room 11. A lock hole 16 is formed through the top of the shell 10 and communicates with the second room 12. An opening 17 is formed through the rear shell 102 and communicates with the lock hole 16.

The combination lock cylinder 20 is mounted in the first room 11 of the shell 10 and comprises multiple external wheels 21, multiple internal wheels 22, a lock rod 23 and a resilient element 24. Each external wheel 21 is mounted through a corresponding through hole 111 of the front shell 101 and is mounted in a corresponding receiving recess 112 of the rear shell 102. Each internal wheel 22 is mounted in a corresponding external wheel 21 and has an identification hole 221 formed through a sidewall thereof. The lock rod 23 is mounted through the internal wheels 22 and has an outer end. The outer end of the lock rod 23 is mounted through the rod hole 15 of the shell 10 and has a curved part 16 extending into the lock hole 16 of the shell 16. The resilient element 24 abuts a bottom end of the lock rod 23. The cooperation between the external wheels 21, the internal wheels 22 and the lock rod 23 results in locking and unlocking the combination lock cylinder 20. The other detailed structure of the combination lock cylinder 20 is well known by a person skilled in the art so that is not described here.

The key lock cylinder 30 is mounted in the second room 12 of the shell 10. The key lock cylinder 30 is unlocked with a key to be rotated. The key lock cylinder 30 has a stop 31, a top end and a notch 34. The stop 31 is formed on an outer wall of the key lock cylinder 30. The top end of the key lock cylinder 30 is hollow, extends out of the lock hole 16 of the shell 10 and is mounted around the curved part 231 of the lock rod 23. The notch 34 is formed transversely through the top end of the key lock cylinder 30. A positioning pin 32 and a resilient element 33 are mounted transversely in the key lock cylinder 30. The positioning pin 32 is mounted slidably in the sliding slot 121 to keep the key lock cylinder 30 from pulling out of the shell 10. The resilient element 33 presses against the positioning pin 32 to abut an inner wall of the shell 10. The other detailed structure of the key lock cylinder 30 is well known by a person skilled in the art so that is not described here.

Figure 5:
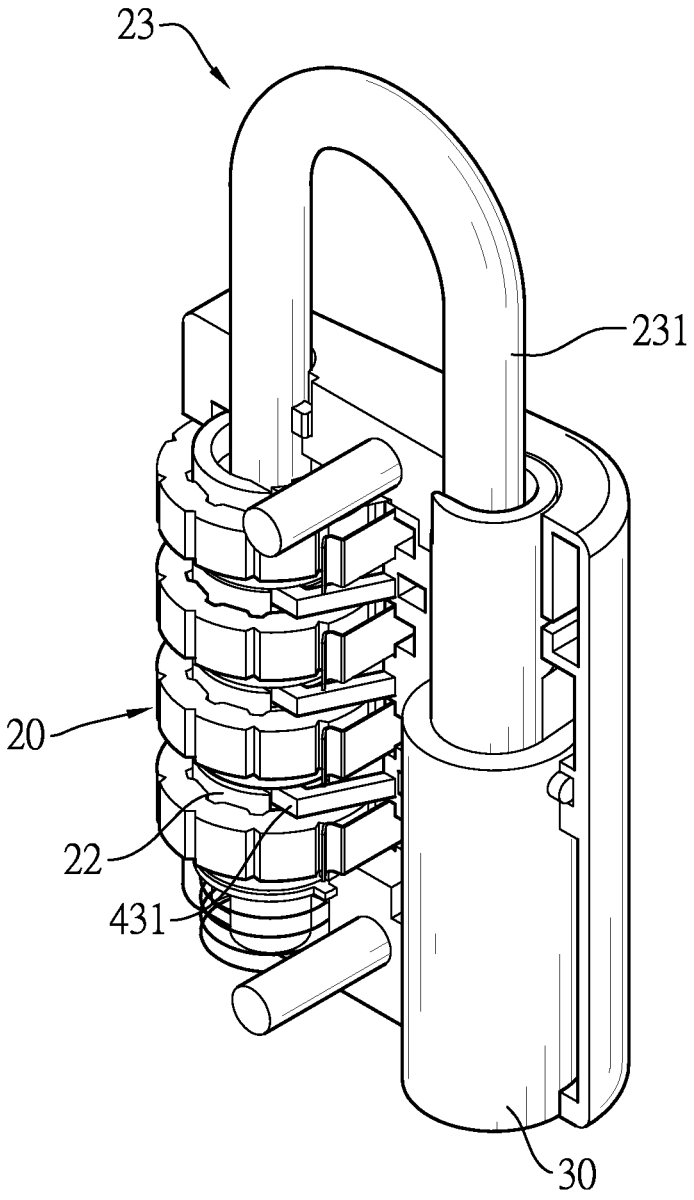
FIG. 5 is a partially perspective view of the combination-identifiable padlock.
Figure 6:
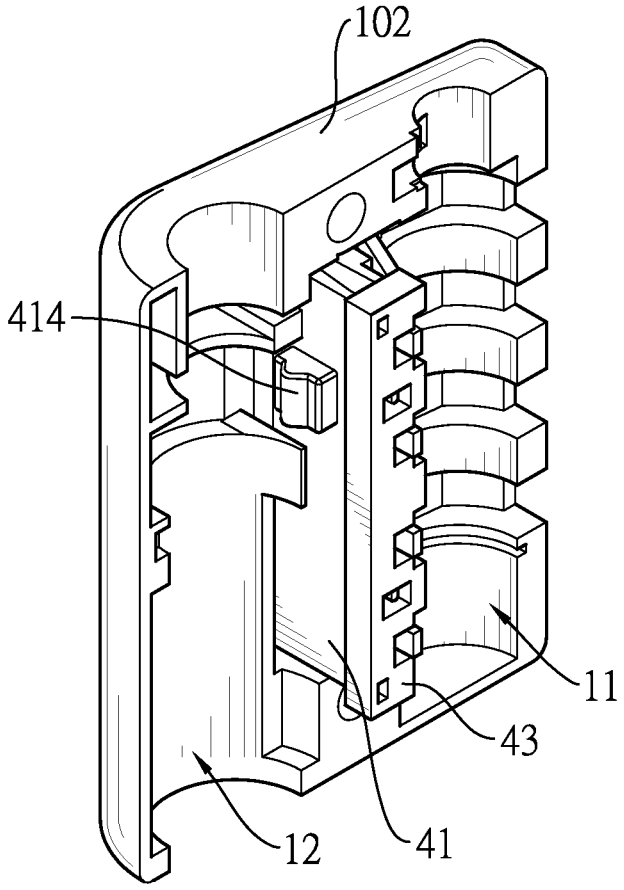
FIG. 6 is another partially perspective view of the combination-identifiable padlock in FIG. 1.

With further reference to FIGS. 5 and 6, the identification assembly 40 is mounted in the third room 13 of the shell 10 and comprises an actuating panel 41, a resilient element 42 and an inactive panel 43. The actuating panel 41 has a first side 411 facing the combination lock cylinder 20 and a second side 412 facing the key lock cylinder 30. A shallow recess 413 is formed on the first side 411. A protrusion 414 is formed on the second side 412. A mounting tag 415 is formed on an edge of the actuating panel 41. The resilient element 42 is mounted in the shallow recess 413 and is clamped between the actuating panel 41 and the partition 14. The inactive panel 43 is connected securely to the actuating panel 41. The inactive panel 43 may have a fastening hole 432 mounted securely around the mounting tag 415 to connect the inactive panel 43 securely to the actuating panel 41. Multiple resilient pawls 431 are formed on a side of the inactive panel 43, selectively protrude into the first room 11 of the shell 10 and selectively engage respectively with the identification holes 221 of the internal wheels 22.

Figure 7:
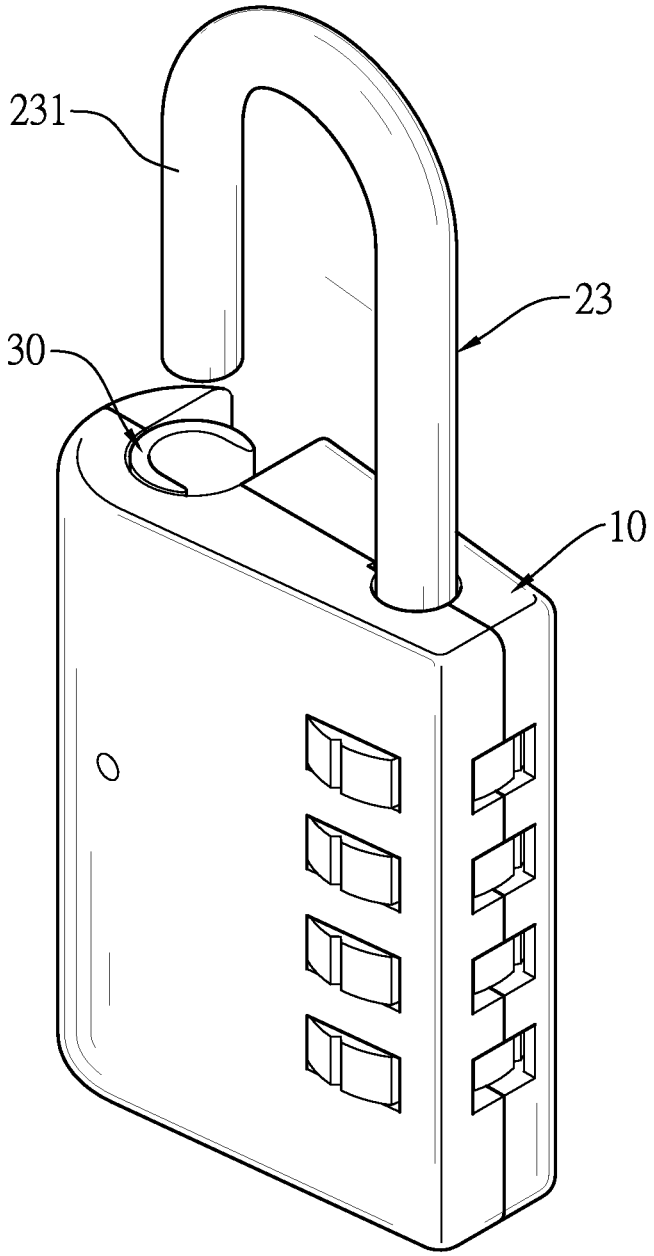
FIG. 7 is an operational perspective view of the combination-identifiable padlock in FIG. 1, shown unlocked with combination lock cylinder.
Figure 8:
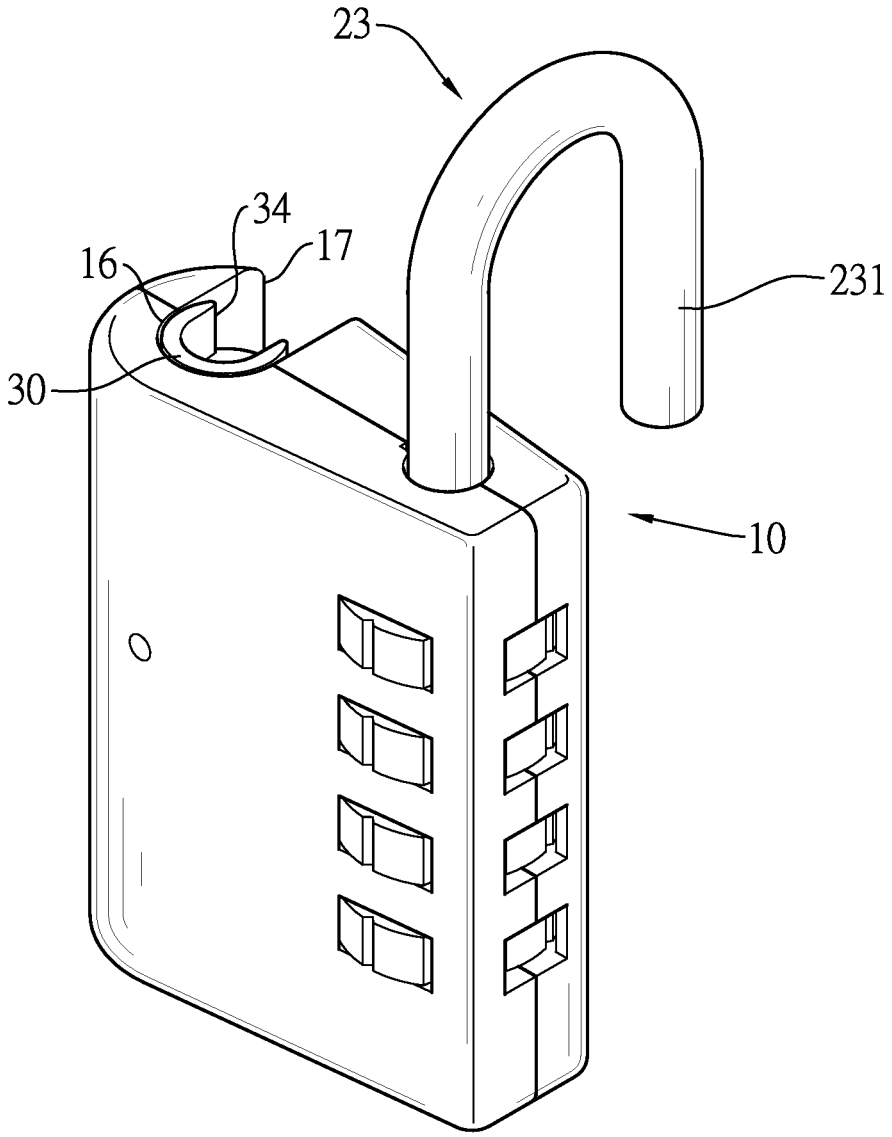
FIG. 8 is an operational perspective view of the combination-identifiable padlock in FIG. 1, shown unlocked with key lock cylinder.

With further reference to FIG. 7, the padlock as described may be unlocked via the combination lock cylinder 20. The curved part 231 of the lock rod 23 is sprung out of the top ends of the shell 10 and the key lock cylinder 30 so that the lock rod 23 is rotated freely and the padlock as described is unlocked. With further reference to FIG. 8, the padlock as described may be unlocked via the key lock cylinder 30. The user rotates the key lock cylinder 30 through the key until the notch 34 of the key lock cylinder 30 communicates with the opening 17 of the shell 10. Then the curved part 231 of the lock rod 23 can be rotated out of the shell 10 through the notch 34 and the opening 17 to unlock the padlock as described.

Figure 9:
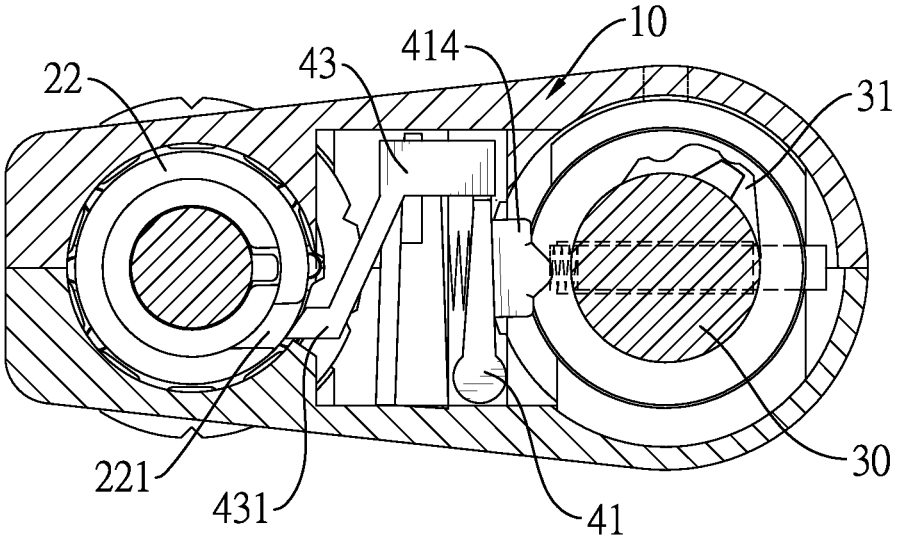
FIGS. 9 and 10 are operational end views in partial section of the combination-identifiable padlock in FIG. 1, showing the inactive panel located at original position.
Figure 10:
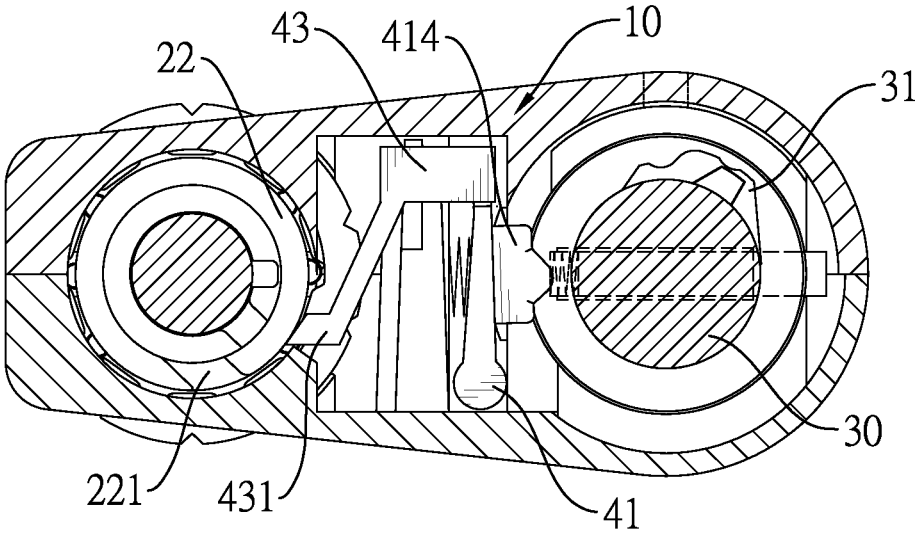

With reference to FIGS. 9 and 10, generally, the stop 31 on the key lock cylinder 30 does not abut the protrusion 414 on the actuating panel 41 so that the resilient pawls 431 of the inactive panel 43 do not interfere the internal wheels 22. No matter the internal wheels 22 are rotated at any angles, the resilient pawls 431 of the inactive panel 43 do not engage the identification holes 221 of the internal wheels 22.

Figure 11:
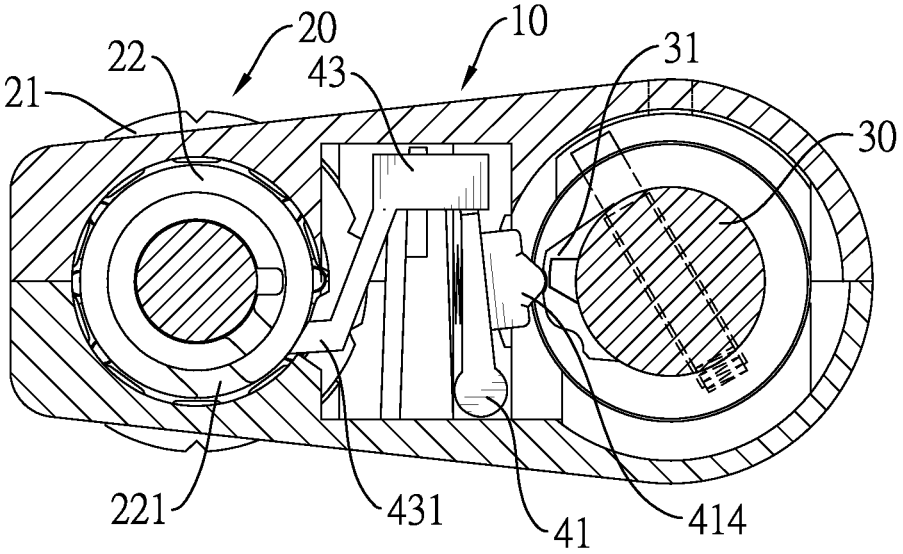
FIGS. 11 and 12 are operational end views in partial section of the combination-identifiable padlock in FIG. 1, showing the inactive panel reaching out.
Figure 12:
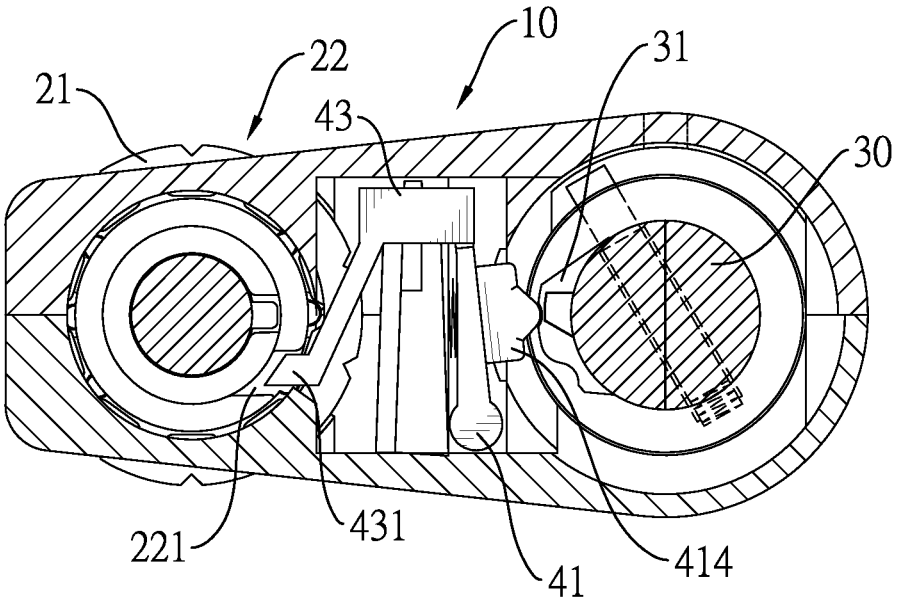

With reference to FIGS. 11 and 12, when the user wants to retrieve the forgotten combination, the key is inserted to rotate the key lock cylinder 30. When the stop 31 of the key lock cylinder 30 abuts the protrusion 414 of the actuating panel 41, the actuating panel 41 is pressed to tilt so that forces the inactive panel 43 to move toward the combination lock cylinder 20. Then the resilient pawls 431 abut against the outer walls of the internal wheels 22 because of the resilience. The external wheels 21 and the internal wheels 22 are rotated to retrieve the forgotten combination. When the identification hole 221 of each internal wheel 22 aligns with the corresponding resilient pawl 431, the resilience forces the corresponding resilient pawl 431 to pivot to engage the identification hole 221. Then the internal wheels 22 and the external wheels 21 are held and cannot be rotated, and the combination lock cylinder 20 is unlocked. At this time, the external wheels 21 show the correct combination so that the combination is retrieved. When the combination is retrieved, the key lock cylinder 30 is rotated back to be locked. Then the stop 31 leaves the protrusion 414 so that the resilient element 42 pushes the actuating panel 41 to move back. Thus, the inactive panel 43 is also pulled back to the original position.

Figure 13:
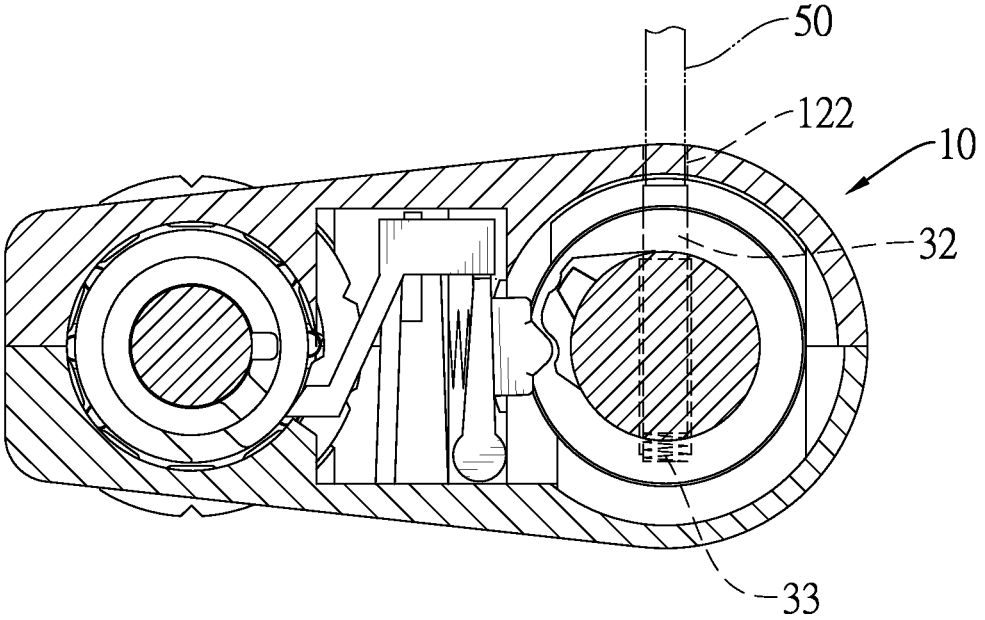
FIGS. 13 and 14 are operational end views in partial section of the combination-identifiable padlock in FIG. 1, showing the operations to change the key lock cylinder.
Figure 14:
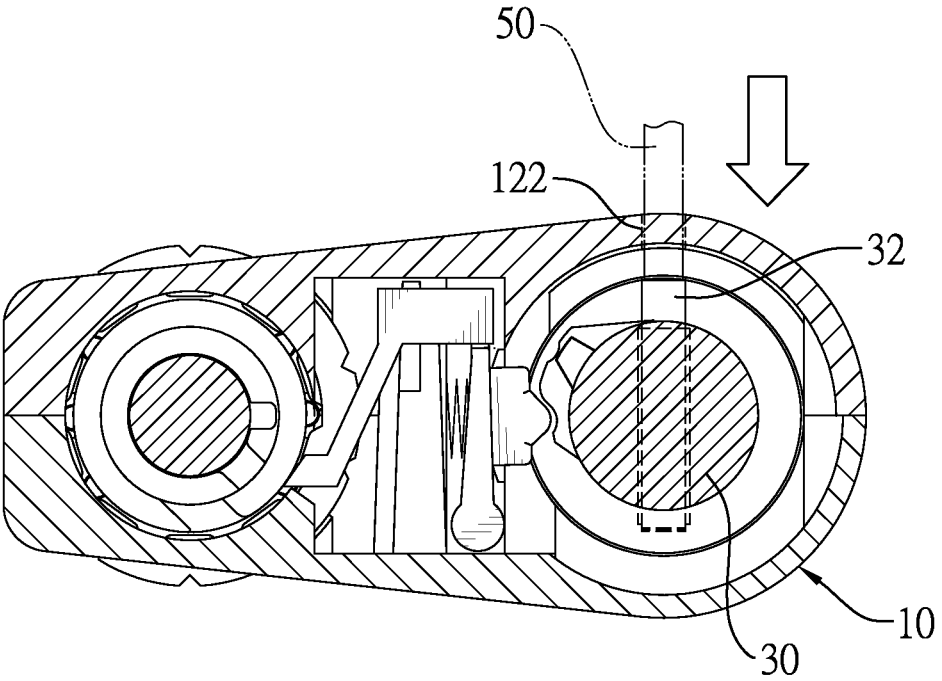
Figure 15:
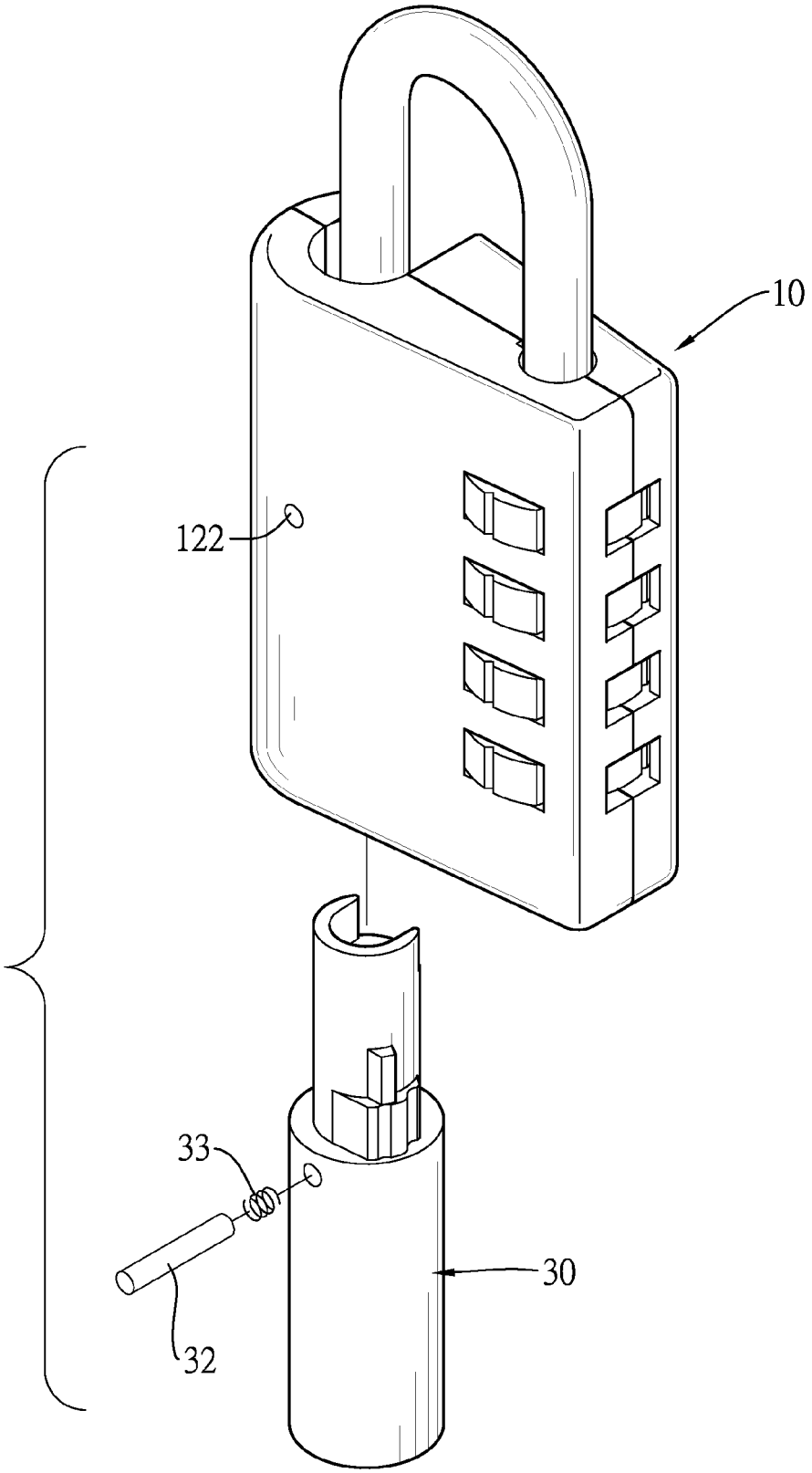
FIG. 15 is another partially exploded perspective view of the combination-identifiable padlock in FIG. 1.

Generally, the positioning pin 32 is mounted in the sliding slot 121 to keep the key lock cylinder 30 from pulling out of the shell 10. However, the key lock cylinder 30 may need to be changed regularly for safety reason. With reference to FIGS. 13 to 15, when the key lock cylinder 30 needs to be changed, the key is inserted into and rotates the key lock cylinder 30. When the positioning pin 32 aligns with the positioning hole 122 of the shell 10, the resilient element 32 forces the positioning pin 32 to engage the positioning hole 122. Then the user put a tool 50 into the positioning hole 122 so that the positioning pin 32 is pressed to leave the sliding slot 121. Therefore, the key lock cylinder 30 can be pulled out of the shell 10 to be replaced.

The padlock as described has following advantages. With the identification assembly 40, the user easily retrieves the forgotten combination simply by inserting the correct key and rotating the wheels 21, 22. Therefore, combination lock cylinder 20 does not lose its function forever since the combination is retrievable. Further, the key lock cylinder 30 can be changed regularly for safety reasons.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A combination-identifiable padlock comprising:

a shell having a front shell and a rear shell connected to each other and having a first room;

a second room;

a third room defined between the first and second rooms;

a partition formed between the second and third rooms;

multiple through holes formed through the front shell and communicating with the first room;

multiple receiving recesses formed in the rear shell and communicating with the third room, and each receiving recess corresponding to one of the through holes on the front shell;

a rod hole formed through a top of the shell and communicating with the first room;

a lock hole formed through the top of the shell and communicating with the second room;

an opening formed through the rear shell and communicating with the lock hole;

a sliding slot formed in the front shell and communicating with the second room; and a positioning hole formed through the front shell and located in the sliding slot;

a combination lock cylinder mounted in the first room of the shell and comprising multiple external wheels, and each external wheel mounted through a corresponding through hole of the front shell and mounted in a corresponding receiving recess of the rear shell;

multiple internal wheels, and each internal wheel mounted in a corresponding external wheel and having an identification hole formed through a sidewall thereof;

a lock rod mounted through the internal wheels and having an outer end mounted through the rod hole of the shell and having a curved part extending into the lock hole of the shell; and a first resilient element abutting a bottom end of the lock rod;

a key lock cylinder mounted in the second room of the shell and having a stop formed on an outer wall of the key lock cylinder;

a top end being hollow, extending out of the lock hole of the shell and mounted around the curved part of the lock rod; and a notch formed transversely through the top end of the key lock cylinder;

an identification assembly mounted in the third room of the shell and comprising an actuating panel having a first side facing the combination lock cylinder;

a second side facing the key lock cylinder; and a protrusion formed on the second side;

a second resilient element clamped between the actuating panel and the partition; and an inactive panel connected securely to the actuating panel and having multiple resilient pawls formed on a side of the inactive panel, selectively protruding into the first room of the shell and selectively engaging respectively with the identification holes of the internal wheels; and a positioning pin mounted transversely in the key lock cylinder and mounted slidably in the sliding slot; and a third resilient element mounted transversely in the key lock cylinder and pressing against the positioning pin to abut an inner wall of the shell.

2. The combination-identifiable padlock as claimed in claim 1, wherein the actuating panel has a shallow recess formed on the first side; and the second resilient element is mounted in the shallow recess.

3. The combination-identifiable padlock as claimed in claim 1, wherein the actuating panel has a mounting tag formed on an edge of the actuating panel; and the inactive panel has a fastening hole mounted securely around the mounting tag.

4. The combination-identifiable padlock as claimed in claim 2, wherein the actuating panel has a mounting tag formed on an edge of the actuating panel; and the inactive panel has a fastening hole mounted securely around the mounting tag.

5. The combination-identifiable padlock as claimed in claim 1, wherein the front and rear shells are connected to each other by multiple mounting pins mounted through multiple mounting holes and riveted to the shell.

6. The combination-identifiable padlock as claimed in claim 2, wherein the front and rear shells are connected to each other by multiple mounting pins mounted through multiple mounting holes and riveted to the shell.

7. The combination-identifiable padlock as claimed in claim 3, wherein the front and rear shells are connected to each other by multiple mounting pins mounted through multiple mounting holes and riveted to the shell.

8. The combination-identifiable padlock as claimed in claim 4, wherein the front and rear shells are connected to each other by multiple mounting pins mounted through multiple mounting holes and riveted to the shell.

* * * * *